US008211286B2

(12) United States Patent
Schramek

(10) Patent No.: US 8,211,286 B2
(45) Date of Patent: Jul. 3, 2012

(54) ELECTROLYTE AND METHOD FOR DEPOSITING DECORATIVE AND TECHNICAL LAYERS OF BLACK RUTHENIUM

(75) Inventor: Philip Schramek, Lorch (DE)

(73) Assignee: Umicore Galvotechnik GmbH, Schwabisch Gmund (DE)

( * ) Notice: Subject to any disclaimer, the term of this patent is extended or adjusted under 35 U.S.C. 154(b) by 150 days.

(21) Appl. No.: 12/532,296

(22) PCT Filed: Mar. 5, 2008

(86) PCT No.: PCT/EP2008/001751
§ 371 (c)(1),
(2), (4) Date: Nov. 11, 2009

(87) PCT Pub. No.: WO2008/116545
PCT Pub. Date: Oct. 2, 2008

(65) Prior Publication Data

US 2010/0051468 A1 Mar. 4, 2010

(30) Foreign Application Priority Data

Mar. 28, 2007 (EP) ..... 07006380

(51) Int. Cl.
*C25D 3/00* (2006.01)

(52) U.S. Cl. ..... 205/261

(58) Field of Classification Search ..... 205/261, 205/262
See application file for complete search history.

(56) References Cited

U.S. PATENT DOCUMENTS

| | | | | | |
|---|---|---|---|---|---|
| 3,530,049 | A | | 9/1970 | Scherzer | |
| 3,692,641 | A | * | 9/1972 | Losi et al. | 205/257 |
| 4,082,624 | A | * | 4/1978 | Heller et al. | 205/264 |
| 4,082,625 | A | * | 4/1978 | Crosby | 205/264 |
| 4,375,392 | A | | 3/1983 | Baker | |
| 4,563,405 | A | * | 1/1986 | Ishikawa et al. | 430/460 |
| 5,077,442 | A | * | 12/1991 | Hara et al. | 568/864 |
| 6,117,301 | A | | 9/2000 | Freudenberger | |

FOREIGN PATENT DOCUMENTS

| | | | | |
|---|---|---|---|---|
| DE | 1959907 | A | * | 6/1970 |
| DE | 19741990 | C1 | | 4/1999 |
| JP | 61104097 | A | | 5/1986 |
| JP | 63259095 | A | | 10/1988 |
| JP | 1119660 | A | | 5/1989 |
| JP | 3226591 | A | | 10/1991 |
| JP | 4154988 | A | | 5/1992 |
| WO | 0111113 | A1 | | 2/2001 |

* cited by examiner

*Primary Examiner* — Edna Wong
(74) *Attorney, Agent, or Firm* — Smith, Gambrell & Russell, LLP

(57) ABSTRACT

The production of oxidation-stable and mechanically strong metal layers having a black color presents a particular challenge in the area of electrochemical finishing, especially since there are only a few metals which are suitable for this purpose. A possibility which is not hazardous to health, in contrast to nickel, and is economical compared with rhodium is the electrochemical production of black ruthenium layers. The invention provides an electrolyte and a method using this electrolyte for producing black ruthenium layers on pieces of jewelry, decorative goods, consumer goods and technical articles. The electrolyte is distinguished in that one or more phosphonic acid derivatives are used as a blackening additive. These maintain brightness. The degree of blackness of the resulting black ruthenium layer can be adjusted by the choice of the type and amount of the phosphonic acid derivatives used, while maintaining the desired brightness.

12 Claims, No Drawings

ELECTROLYTE AND METHOD FOR DEPOSITING DECORATIVE AND TECHNICAL LAYERS OF BLACK RUTHENIUM

INTRODUCTION AND BACKGROUND

The invention relates to a ruthenium electrolyte which is suitable for depositing decorative and technical layers having particular blackness. Furthermore, the invention relates to a method for depositing decorative and technical layers of ruthenium having particular blackness ("black ruthenium") on pieces of jewelry, decorative goods, consumer goods and technical articles.

Consumer goods and technical articles, pieces of jewelry and decorative goods are finished with thin oxidation-stable metal layers for protection from corrosion and/or for visual upgrading. These layers must be mechanically stable and should show no tarnishing or signs of wear even with relatively long use. A tried and tested means of producing such layers comprises electroplating methods by means of which a multiplicity of metal and alloy layers can be obtained in high quality. Examples well known from everyday life are electrodeposited bronze and brass layers on door handles or knobs, chromium coatings on vehicle parts, galvanized tools or gold coatings on watchstraps.

A particular challenge in the area of electrochemical finishing is the production of oxidation-stable and mechanically strong black metal layers which may be of interest not only in the area of decoration and jewelry but also for technical applications, for example in the area of solar engineering. Only a few metals are available for producing oxidation-stable, black layers. In addition to ruthenium, rhodium and nickel are suitable. The use of the noble metal rhodium is limited to the area of jewelry, owing to the high raw material costs. The use of economical nickel and nickel-containing alloys is possible, particularly in the area of jewelry and consumer goods, only in exceptional cases and taking into account stringent requirements, since nickel and nickel-containing metal layers are contact allergens. The use of ruthenium is an expedient alternative for all fields of use described.

Electrolytes for the production of black ruthenium layers in electroplating methods for finishing are known in the prior art. The most customary baths contain ruthenium in a form complexed with amidosulfonic acid or ruthenium as a nitridochloro or nitridobromo complex.

For example JP 63259095 describes a method for ruthenium electroplating using a bath containing 5 g/l of ruthenium and from 100 to 150 g/l of amidosulfonic acid. WO 2001/011113 discloses a ruthenium electrolyte which contains ruthenium sulfate and sulfamic acid (amidosulfonic acid). A thio compound is used as a blackening additive. For protecting the thio compound from decomposition by anodic oxidation, a sacrificial substance must also be added. An electrolyte for electrochemical deposition of low-stress ruthenium layers having good tensile strength according to DE 197 41 990 contains ruthenium in a form complexed with amidosulfuric acid and pyridine or N-alkylated pyridinium salts. U.S. Pat. No. 4,375,392 claims an acidic electrolyte for the deposition of ruthenium onto various substrates containing a complex of ruthenium and amidosulfonic acid, which is present in a molar concentration of from 4 to 10 mol of amidosulfonic acid per mole of ruthenium and in suitable concentration, and containing a second compound of a metal selected from the group consisting of nickel, cobalt, iron, tin, lead and magnesium. The concentration of the second metal is chosen so that ruthenium layers having good tensile strength can be deposited. The pH of the bath is from 0.1 to 2.2.

DE 1 959 907 describes the use of the dinuclear ruthenium complex $[Ru_2NCl_xBr_{8-x}(H_2O)_2]^{3-}$ in an electroplating bath. In one embodiment, the nitridochloro complex $[Ru_2NCl_8(H_2O)_2]^{3-}$ is used. This nitridochloro complex of ruthenium is also used in the aqueous, nonacidic bath for the electrodeposition of ruthenium, which is described in U.S. Pat. No. 4,297,178. Oxalic acid or an oxalate is also present therein.

JP 56119791 has a ruthenium electrolyte as the subject of the invention, which, in addition to from 1 to 20 g/l of ruthenium, contains one or more compounds selected from the group of di- and tricarboxylic acids, benzenesulfonic acid, N-containing aromatics and amino acids or derivatives of said compounds and in which moreover from 0.01 to 10 g/l of a thio compound are present as a blackening additive.

JP 2054792 preferably contains ruthenium sulfate, an inorganic acid, preferably sulfuric acid, and a "metal of group III", preferably Sc, Y, In or Ga, in addition to an inorganic ruthenium salt.

For the finishing of jewelry and decorative goods, black layers must have not only excellent mechanical adhesive strength but also a satisfactory visual quality. If required, they must be capable of being produced in bright or dull form and with very deep blackness. The same applies to applications in the technical area, in particular in solar engineering. Black layers for the finishing of consumer goods must moreover meet high requirements with regard to the mechanical stability. In particular, they must not exhibit any black abrasion even with frequent use over a relatively long time.

The ruthenium baths which are described in the prior art and meet these requirements are either dependent on the use of toxicologically unsafe compounds, such as thio compounds, as a blackening additive or contain a further transition metal for ensuring the required mechanical adhesive strength, which complicates the handling of the bath during the deposition process.

SUMMARY OF THE INVENTION

It was therefore the object of the present invention to provide a nontoxic electrolyte for depositing layers of ruthenium having particular blackness ("black ruthenium"), by means of which, in a standard electroplating method, it is possible to produce black layers which are distinguished by high mechanical stability, in particular by abrasion resistance even with frequent use, and which moreover can be produced in various degrees of blackness so as to maintain brightness.

This object is achieved by an electrolyte which contains one or more phosphonic acid derivatives as a blackening additive. A method by means of which decorative and technical layers of ruthenium having particular blackness ("black ruthenium") can be applied to pieces of jewelry, decorative goods, consumer goods and technical articles using the electrolyte according to the invention is also provided, the substrates to be coated being immersed in the electrolyte according to the invention.

In the context of this document, "nontoxic" is understood as meaning that the electrolyte according to the invention which is thus designated contains no substances which are to be classified as "toxic" (T) or "very toxic" ($T^+$) according to the regulations applicable in Europe on the handling of dangerous goods and hazardous materials.

Ruthenium is used in the form of a water-soluble compound, preferably as a dinuclear, anionic nitridohalogeno complex compound of the formula $[Ru_2N(H_2O)_2X_8]^{3-}$, where X is a halide ion. The chloro complex $[Ru_2N(H_2O)_2$ $Cl_8]^{3-}$ is particularly preferred. The amount of the complex compound in the electrolyte according to the invention is chosen so that the volume concentration of the ruthenium after complete dissolution of the compound is from 0.2 to 20 grams per liter of electrolyte, calculated as ruthenium metal. The finished electrolyte particularly preferably contains from 1 to 15 grams of ruthenium per liter of electrolyte, very particularly preferably from 3 to 10 grams of ruthenium per liter of electrolyte.

The blackening of the electrochemically produced ruthenium layers is achieved by inhibiting the deposition rate from the electroplating bath in a targeted manner. One or more phosphonic acid derivatives are present as an inhibitor and hence as a blackening additive in the bath according to the invention.

DETAILED DESCRIPTION OF INVENTION

Preferably used compounds are aminophosphonic acid AP, 1-aminomethylphosphonic acid AMP, aminotris(methylenephosphonic acid) ATMP, 1-aminoethylphosphonic acid AEP, 1-aminopropylphosphonic acid APP, (1-acetylamino-2,2,2-trichloroethyl)phosphonic acid, (1-amino-1-phosphonooctyl)phosphonic acid, (1-benzoylamino-2,2,2-trichloroethyl) phosphonic acid, (1-benzoylamino-2,2-dichlorovinyl) phosphonic acid, (4-chlorophenylhydroxymethyl) phosphonic acid, diethylenetriaminepenta (methylenephosphonic acid) DTPMP, ethylenediaminetetra (methylenephosphonic acid) EDTMP, 1-hydroxyethane(1,1-diphosphonic acid) HEDP, hydroxyethylaminodi (methylenephosphonic acid) HEMPA, hexamethylenediaminetetra(methylphosphonic acid) HDTMP, ((hydroxymethylphosphonomethylamino)methyl) phosphonic acid, nitrilotris(methylenephosphonic acid) NTMP, 2,2,2-trichloro-1-(furan-2-carbonyl)-aminoethylphosphonic acid, salts derived therefrom or condensates derived therefrom, or combinations thereof.

One or more compounds selected from the group consisting of aminotris(methylenephosphonic acid) ATMP, diethylenetriaminepenta(methylenephosphonic acid) DTPMP, ethylenediaminetetra(methylenephosphonic acid) EDTMP, 1-hydroxyethane(1,1-diphosphonic acid) HEDP, hydroxyethylaminodi(methylenephosphonic acid) HEMPA, hexamethylenediaminetetra(methylphosphonic acid) HDTMP, salts derived therefrom or condensates derived therefrom, or combinations thereof are particularly preferably used. Aminotris (methylenephosphonic acid) ATMP, ethylenediaminetetra (methylenephosphonic acid) EDTMP and 1-hydroxyethane (1,1-diphosphonic acid) HEDP and salts derived therefrom or condensates derived therefrom, or combinations thereof are in particular outstandingly suitable for the coating of decorative goods and consumer goods.

The concentration of the blackening additive determines the degree of blackness of the layer to be produced. It must be chosen so that the desired deep blackness is achieved but must not be too high. If the concentration of the blackening additive is chosen too high, current densities at which the adhesive strength of the resulting ruthenium layer is no longer guaranteed have to be chosen in order to ensure economical deposition rates. The electrolyte according to the invention preferably contains from 0.1 to 20 grams of phosphonic acid derivatives per liter of electrolyte, particularly preferably from 1 to 10 grams of phosphonic acid derivatives per liter of electrolyte. If it is intended to achieve dark gray colorations which are not deep black, from 0.1 to 4 grams of phosphonic acid derivatives in a liter of electrolyte are preferred.

The phosphonic acid derivatives used have a brightness-maintaining effect. By a suitable choice of the type and amount of the phosphonic acid derivatives, the color of the resulting layer can be adjusted in all variants from light black to deep black without changing its characteristic brightness.

The pH of the bath according to the invention has an important influence on the controllability of the electrolyte during the deposition process and the quality of the resulting black ruthenium layers. It is preferably from 0 to 3, particularly preferably from 0.5 to 2. For establishing the pH, the electrolyte according to the invention may contain inorganic mineral acids, preferably selected from the group consisting of hydrochloric acid, hydrobromic acid, hydriodic acid, nitric acid, nitrous acid, amidosulfonic acid, sulfuric acid, sulfurous acid, disulfuric acid, dithionic acid, disulfurous acid and dithionous acid or combinations thereof. Hydrochloric acid, hydrobromic acid, amidosulfonic acid and sulfuric acid or combinations thereof are particularly suitable. Depending on the phosphonic acid derivative used and the concentration in which it is used and the mineral acid chosen, the preferred volume concentration of the inorganic mineral acid is from 0 to 50 grams per liter of electrolyte, particularly preferably from 0 to 40 grams per liter of electrolyte. Electrolytes particularly suitable for the deposition of uniform, decorative black ruthenium layers contain from 1 to 10 grams of sulfuric acid per liter of electrolyte.

In addition to ruthenium and the phosphonic acid derivatives, the electrolyte may contain organic additives which perform the function of the wetting agent. The addition of one or more compounds selected from the group consisting of the alkanesulfonic acids or the ionic and nonionic surfactants or combinations thereof is preferred. Alkanesulfonic acids are particularly suitable.

The bath according to the invention is suitable for depositing layers of pure ruthenium, but not for depositing ruthenium alloys. Apart from ruthenium, the electrolyte contains no transition metal ions.

The ruthenium electrolyte described, which is a subject of the present invention, is particularly suitable for depositing decorative deep black bright layers, for example on pieces of jewelry and decorative goods. It can preferably be used in drum and rack coating methods.

In a corresponding method for the electrochemical application of black ruthenium layers, the pieces of jewelry, decorative goods, consumer goods or technical articles (referred to together as substrates) to be coated dip into the electrolyte according to the invention and form the cathode. The electrolyte is preferably thermostated in a range from 20 to 80° C. In particular, decorative layers are obtained at electrolyte temperatures of from 60 to 70° C.

In order to obtain firmly adhering, uniform layers, a maximum current density of 10 amps per square decimeter [$A/dm^2$] should not be exceeded. Above this value, amorphous ruthenium fractions are deposited. As a result, the layers become nonuniform and exhibit dark abrasion under mechanical load. A current density of from 0.01 to 10 $A/dm^2$ is preferably established, particularly preferably from 0.05 to 5 $A/dm^2$. The chosen value is also determined by the type of coating method. In a drum coating method, the preferred current density is from 0.05 to 1 $A/dm^2$. In rack coating methods, a current density of from 0.5 to 5 $A/dm^2$ leads to visually satisfactory black ruthenium layers.

Insoluble anodes are suitable for carrying out the electrochemical deposition process from the acidic ruthenium bath according to the invention. Preferably used anodes are those comprising a material selected from the group consisting of platinized titanium, graphite, iridium transition metal mixed oxide and special carbon material ("Diamond Like Carbon" DLC) or combinations thereof.

The following examples are intended to explain the invention in more detail:

EXAMPLE 1

An electrolyte according to the invention which, in addition to 2.5 g/l of ruthenium in $[Ru_2NCl_8(H_2O)_2]^{3-}$, contained 15 g/l of 1-hydroxyethane(1,1-diphosphonic acid) HEDP dissolved in water as a blackening additive and 20 g/l of sulfuric acid was used for depositing black layers on consumer goods. The electrolyte had a pH of 0.8.

In a rack coating method, appropriate substrates were coated at a current density of 2-10 A/dm$^2$, the electrolyte being thermostated at 60° C.

After the end of the deposition process, the substrates had been provided with mechanically stable, abrasion-resistant black layers which are considered to be visually satisfactory in the area of consumer goods. A slight irregularity in the layer thickness of the layers obtained limits the use of this bath according to the invention to applications outside the jewelry area.

EXAMPLE 2

An electrolyte according to the invention which contained 5 g/l of ruthenium in $[Ru_2NCl_8(H_2O)_2]^{3-}$ and 1.5 g/l of ethylenediaminetetra(methylenephosphonic acid) EDTMP as a blackening additive in water was used for producing black ruthenium layers on decorative goods. 4 g/l of sulfuric acid were added to the electrolyte for establishing the pH, so that the pH at the beginning of the deposition was 1.3.

In a rack apparatus, suitable substrates were finished with black ruthenium layers at a set current density of from 0.5 to 3 A/dm$^2$. During the deposition process, the electrolyte was thermostated at from 60 to 70° C.

The layers obtained had very good mechanical stability and showed a deep black color and great brightness. The visual quality of the layers thus produced was so high that this bath according to the invention is also suitable for the jewelry and decorative area.

EXAMPLE 3

A further bath according to the invention which contained 5 g/l of ruthenium in $[Ru_2NCl_8(H_2O)_2]^{3-}$ and 5 g/l of aminotris(methylenephosphonic acid) ATMP in water was investigated. The pH of the bath was adjusted to 1.4 with 4 g/l of sulfiric acid.

In a rack coating method, uniform, deep black layers of high visual quality were likewise obtained at a set current density of from 0.5 to 2.5 A/dm$^2$ and with thermostating of the bath at 60° C.

The invention claimed is:

1. A nontoxic electrolyte for depositing decorative and technical layers of ruthenium having particular blackness ("black ruthenium") comprising an aqueous solution which contains one or more phosphonic acid derivatives as a blackening additive and a volume concentration of a ruthenium is from 0.2 to 20 grams per liter of electrolyte, calculated as ruthenium metal, wherein the ruthenium is present as a dinuclear, anionic ruthenium-nitridohalogeno complex compound of the formula $[Ru_2N(H_2O)_2X_8]^{3-}$, wherein X is a halide ion.

2. The electrolyte as claimed in claim 1, wherein the electrolyte is free of further transition metal ions.

3. The electrolyte as claimed in claim 1, wherein the one or more phosphonic acid derivatives is selected from the group consisting of aminophosphonic acid AP, 1-aminomethylphosphonic acid AMP, aminotris(methylenephosphonic acid) ATMP, 1-aminoethylphosphonic acid AEP, 1-aminopropylphosphonic acid APP, (1-acetylamino-2,2,2-trichloroethyl)phosphonic acid, (1-amino-1-phosphonooctyl)phosphonic acid, (1-benzoylamino-2,2,2-trichloroethyl) phosphonic acid, (1-benzoylamino-2,2-dichlorovinyl) phosphonic acid, (4-chlorophenylhydroxymethyl) phosphonic acid, diethylenetriaminepenta(methylenephosphonic acid) DTPMP, ethylenediaminetetra(methylenephosphonic acid) EDTMP, 1-hydroxyethane(1,1-diphosphonic acid) HEDP, hydroxyethylaminodi(methylenephosphonic acid) HEMPA, hexamethylenediaminetetra(methylphosphonic acid) HDTMP, ((hydroxymethylphosphonomethylamino)methyl)phosphonic acid, nitrilotris(methylenephosphonic acid) NTMP, 2,2,2-trichloro-1-(furan-2-carbonyl)-aminoethylphosphonic acid, salts thereof, condensates thereof, and combinations thereof.

4. The electrolyte as claimed in claim 3, wherein the electrolyte contains from 0.1 to 20 grams of the one or more phosphonic acid derivatives per liter of electrolyte.

5. The electrolyte as claimed in claim 3, wherein the pH of the electrolyte is from 0 to 3.

6. The electrolyte as claimed in claim 5, wherein the electrolyte further contains inorganic mineral acids selected from the group consisting of hydrochloric acid, hydrobromic acid, hydriodic acid, nitric acid, nitrous acid, amidosulfonic acid, sulfuric acid, sulfurous acid, disulfuric acid, dithionic acid, disulfurous acid, dithionous acid and mixtures thereof.

7. The electrolyte as claimed in claim 3, wherein the electrolyte further contains one or more compounds selected from the group consisting of alkanesulfonic acids, ionic and nonionic surfactants, and combinations thereof as wetting agents.

8. A method for the electrochemical application of decorative and technical layers of ruthenium having particular blackness ("black ruthenium") to a substrate which comprises:

immersing the substrate in an electrolyte which contains a ruthenium in dissolved form and one or more phosphonic acid derivatives as a blackening additive, and carrying out electrochemical deposition.

9. The method as claimed in claim 8, wherein the electrolyte is thermostated in the range from 20 to 80° C.

10. The method as claimed in claim 9, wherein a current density which is in the range from 0.01 to 10 amps per square decimeter is established.

11. The method as claimed in claim 10, wherein insoluble anodes comprising a material selected from the group consisting of platinized titanium, graphite, iridium transition metal mixed oxide, a diamond-like carbon, and combinations thereof are used in carrying out the electrochemical deposition.

12. The method as claimed in claim 8, wherein the substrate is selected from the group consisting of pieces of jewelry, decorative goods, consumer goods, and technical articles.

* * * * *